US012612681B2

(12) United States Patent
Wang

(10) Patent No.: US 12,612,681 B2
(45) Date of Patent: Apr. 28, 2026

(54) METHOD FOR RECYCLING NICKEL, COBALT AND MANGANESE FROM FEED LIQUID CONTAINING NICKEL, COBALT AND MANGANESE

(71) Applicant: SUZHOU BOTREE CYCLING SCI & TECH CO., LTD, Suzhou (CN)

(72) Inventor: Xue Wang, Suzhou (CN)

(73) Assignee: Suzhou Botree Cycling Sci & Tech Co., Ltd., Suzhou (CN)

( * ) Notice: Subject to any disclaimer, the term of this patent is extended or adjusted under 35 U.S.C. 154(b) by 545 days.

(21) Appl. No.: 18/024,450

(22) PCT Filed: Jul. 12, 2021

(86) PCT No.: PCT/CN2021/105654

§ 371 (c)(1),
(2) Date: Mar. 2, 2023

(87) PCT Pub. No.: WO2022/048307

PCT Pub. Date: Mar. 10, 2022

(65) Prior Publication Data

US 2023/0332269 A1 Oct. 19, 2023

(30) Foreign Application Priority Data

Sep. 4, 2020 (CN) ..... 202010921237.9

(51) Int. Cl.
*C22B 3/00* (2006.01)
*C22B 3/30* (2006.01)
(Continued)

(52) U.S. Cl.
CPC ..... *C22B 23/0453* (2013.01); *C22B 3/30* (2021.05); *C22B 3/32* (2021.05); *C22B 3/38* (2021.05); *C22B 7/006* (2013.01); *C22B 47/00* (2013.01)

(58) Field of Classification Search
CPC ..... C22B 23/0453; C22B 3/30; C22B 3/32; C22B 3/38; C22B 7/006; C22B 47/00;
(Continued)

(56) References Cited

U.S. PATENT DOCUMENTS 3,701,650 A 10/1972 Van Der Zeeuw
2002/0053260 A1 5/2002 Nakon
2023/0312449 A1* 10/2023 Wang ..... C07C 59/125 562/579

FOREIGN PATENT DOCUMENTS

AU 2005209326 A1 8/2005
CA 3125089 A1 7/2020
(Continued)

OTHER PUBLICATIONS

JP2016194105A Translation (Year: 2016).*
(Continued)

*Primary Examiner* — Danielle M. Carda
(74) *Attorney, Agent, or Firm* — KDW Firm PLLC

(57) ABSTRACT

A method for recycling nickel, cobalt and manganese from a feed liquid containing nickel, cobalt and manganese, the method comprising: (1) subjecting the feed liquid to a first extraction to obtain an aqueous phase 1 and an organic phase 1; (2) subjecting the aqueous phase 1 to a second extraction to obtain an organic phase 2 and an aqueous phase 2 having a pH value of 5-7.5; and (3) successively subjecting the organic phase 2 to washing and reverse extraction to obtain a solution containing nickel, cobalt and manganese, wherein an extractant A used in the second extraction comprises a carboxylic acid extractant.

11 Claims, 1 Drawing Sheet

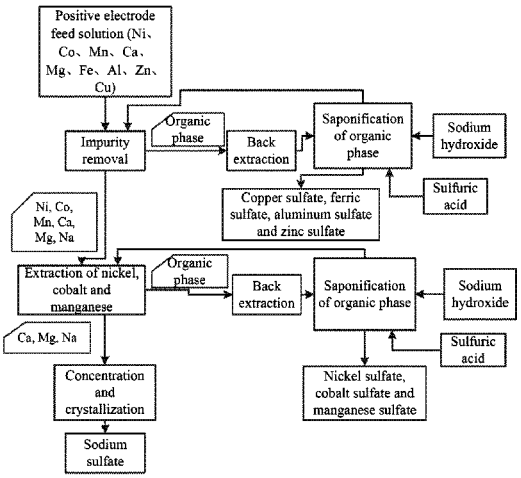

(51) Int. Cl.

| | |
|---|---|
| ***C22B 3/32*** | (2006.01) |
| ***C22B 3/38*** | (2006.01) |
| ***C22B 7/00*** | (2006.01) |
| ***C22B 47/00*** | (2006.01) |

(58) Field of Classification Search

CPC ... C22B 3/3842; C22B 3/3844; C22B 3/3846; C22B 3/326; C22B 3/404; C22B 23/0461; B01D 9/0018; B01D 11/0257; B01D 11/0284; B01D 11/0288; B01D 11/0488; B01D 11/0492; Y02P 10/20; Y02W 30/84; H01M 10/54

USPC ..... 75/743

See application file for complete search history.

(56) References Cited

FOREIGN PATENT DOCUMENTS

| | | | | | |
|---|---|---|---|---|---|
| CN | 103421951 | A | | 12/2013 | |
| CN | 105483382 | A | | 4/2016 | |
| CN | 106319228 | A | | 1/2017 | |
| CN | 107815542 | A | | 3/2018 | |
| CN | 108315555 | A | | 7/2018 | |
| CN | 109097599 | A | | 12/2018 | |
| CN | 111268750 | A | | 6/2020 | |
| CN | 111378516 | A | | 7/2020 | |
| CN | 111592459 | A | * | 8/2020 | ..... C07C 59/125 |
| EP | 4140558 | A1 | | 3/2023 | |
| JP | 2016194105 | A | * | 11/2016 | |
| JP | 2020019665 | A | | 2/2020 | |
| WO | 2020061639 | A1 | | 4/2020 | |

OTHER PUBLICATIONS

Australian Examination Report No. 1 for AU Application No. 2021338230, dated Feb. 22, 2024, 5 pages.

International Search Report mailed Oct. 13, 2021, for Application No. PCT/CN2021/105654 (four (4) pages).

First Office Action dated 2022-07-01 for Chinese patent application No. 202010921237.9 (16 pages).

Extended European Search Report in EP Application No. 21863375.8 dated May 22, 2025, 9 pages.

* cited by examiner

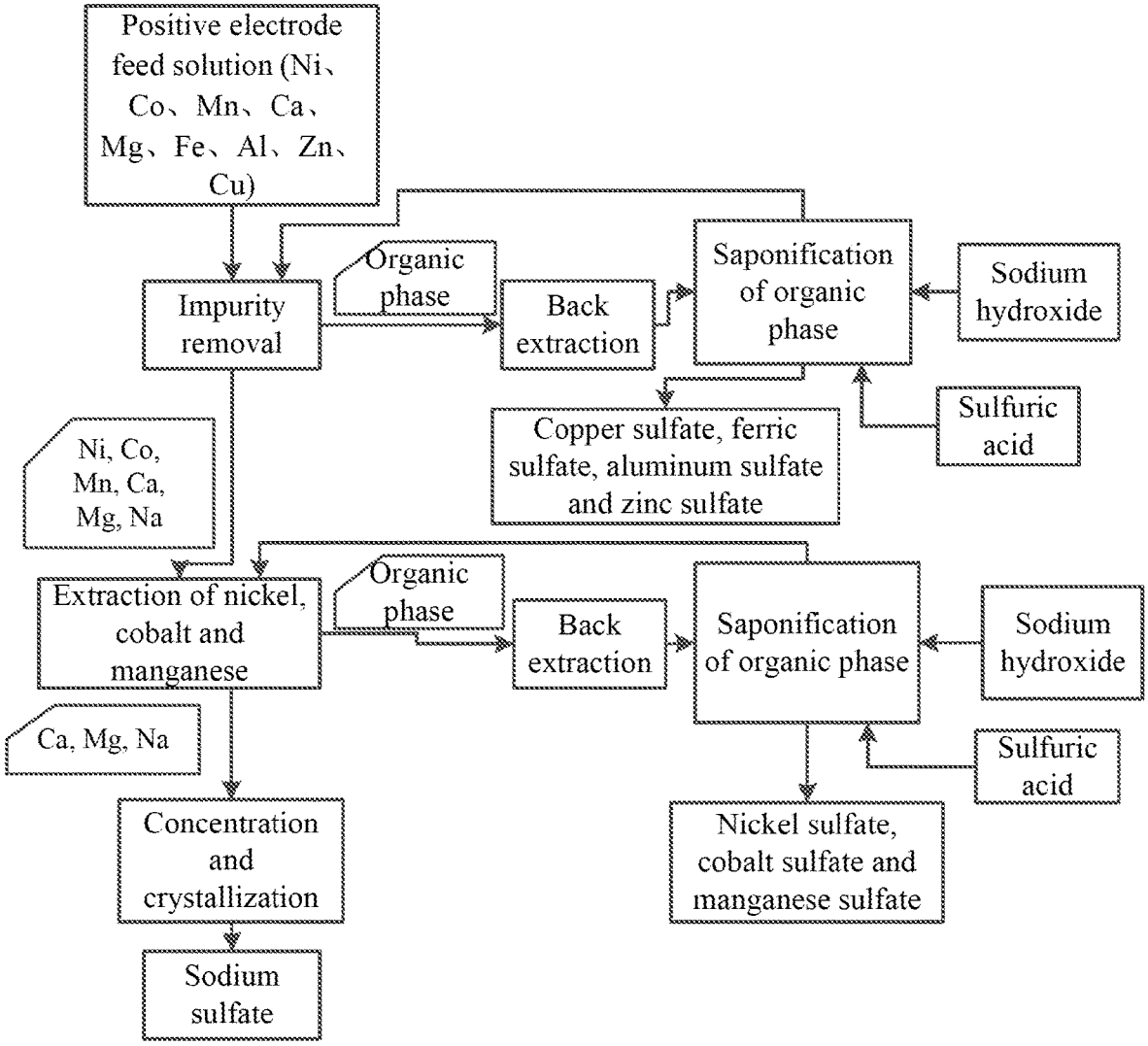
Positive electrode feed solution (Ni、Co、Mn、Ca、Mg、Fe、Al、Zn、Cu)
Impurity removal
Organic phase
Back extraction
Saponification of organic phase
Sodium hydroxide
Sulfuric acid
Copper sulfate, ferric sulfate, aluminum sulfate and zinc sulfate
Ni, Co, Mn, Ca, Mg, Na
Extraction of nickel, cobalt and manganese
Organic phase
Back extraction
Saponification of organic phase
Sodium hydroxide
Sulfuric acid
Ca, Mg, Na
Concentration and crystallization
Nickel sulfate, cobalt sulfate and manganese sulfate
Sodium sulfate

METHOD FOR RECYCLING NICKEL, COBALT AND MANGANESE FROM FEED LIQUID CONTAINING NICKEL, COBALT AND MANGANESE

TECHNICAL FIELD

The present application belongs to the field of resource recovery, and relates to a method for recycling nickel, cobalt and manganese from a feed solution containing nickel, cobalt and manganese.

BACKGROUND

As a new type of positive electrode material for lithium-ion batteries, the nickel-cobalt-manganese ternary positive electrode material has good cycle performance, stable structure and high performance cost ratio. The main raw materials of precursor products of the ternary positive electrode material are nickel salt, cobalt salt and manganese salt. With the rapid development and popularization of electric vehicles, the demand scale of lithium-ion batteries is increasingly expanding, and the number of waste lithium-ion batteries has also been increasing. If the waste lithium batteries are discarded casually, not only the environment will be seriously polluted, but the valuable metal resources are also wasted profoundly. The best way to solve this problem is to realize the recycling of nickel, cobalt and manganese.

Hydrometallurgy is a technique to separate, enrich and extract metal, in which the valuable metal components in ore, concentrate, waste battery positive electrode materials or other materials are dissolved into solutions by the leaching agent or precipitated as a new solid phase, and it has the characteristics of low energy consumption, low pollution and high resource utilization rate, and has attracted constant attention and been developed by many researchers.

CN110066925A discloses a method for recycling valuable metals from waste nickel-cobalt-manganese ternary lithium batteries. The method adopts P204 to extract the battery feed solution, then back extraction is carried out to obtain a back extraction solution containing manganese sulfate and a raffinate containing Co, Ni and Li ions, and after removing Cu, the back extraction solution is evaporated, concentrated and crystallized to obtain manganese sulfate; the Co of the raffinate is extracted by using the saponified P507, and back-extracted to obtain a cobalt sulfate solution; the Mg of the raffinate is removed by using C272, and finally the Ni of the raffinate is extracted by using P507 and back-extracted to obtain a nickel sulfate solution. A method for removing Fe, Al, Ca and Mg in leachate: a concentration of bivalent Fe in the leachate is detected, an oxidant is added to oxidize bivalent Fe into trivalent Fe, and sodium carbonate is added to adjust the pH value of the leachate to 4.5-5.0 to precipitate and remove Fe and Al; contents of Ca and Mg are detected, and sodium fluoride or potassium fluoride is added to precipitate and filter out Ca and Mg. The process flow is complicated, and the separation cost of separately recovering Ni, Co and Mn elements is high. The loss of valuable metals by entrainment easily occurs when the impurity metal ions such as Ca and Mg are removed by precipitation method.

CN105483382A discloses a method for synchronously recovering nickel, cobalt and manganese from waste residues containing nickel, cobalt and manganese. In the method, an oxidant such as hypochlorite or nitric acid is added, the pH value is adjusted to 5.0-5.5, and the Fe and Al of the leachate are first removed to obtain a raffinate after removing Fe and Al; then Mextral 984H or CP50 extractant is used, the pH value is adjusted to 2.0-2.5, and the Cu of the raffinate is removed; then P507 is used with kerosene as diluent, the pH value is adjusted to 2.0-2.3, the Zn and a small amount of Mn of the raffinate are extracted and removed, the organic phase containing Zn and a small amount of Mn is washed with dilute sulfuric acid and back-extracted with sulfuric acid to obtain a back extraction solution containing Zn and a small amount of Mn, and the Zn and Mn in the back extraction solution are extracted and separatied with P204; in the end, the Ni, Co and Mn are synchronously extracted by a mixing extractant of tributyl phosphate and neodecanoic acid, and the obtained organic phase containing Ni, Co and Mn is washed with dilute sulfuric acid to remove calcium and magnesium impurities, and back-extracted with sulfuric acid to obtain a mixing solution of Ni, Co and Mn. The process flow is complicated, the mixing extractant is used, and the operation is unstable.

SUMMARY

An object of the present application is to provide a method for recycling nickel, cobalt and manganese from a feed solution containing nickel, cobalt and manganese. A carboxylic acid extractant used in the present application can synchronously extract nickel, cobalt and manganese with high extraction efficiency and good separation effect from impurity ions; the extractant has low water solubility and environmental friendliness; the organic phase can be recycled, and has low operating cost and good economic benefits.

To achieve the object, the present application adopts the technical solutions below.

The present application provides a method for recycling nickel, cobalt and manganese from a feed solution containing nickel, cobalt and manganese, which includes the following steps:

(1) subjecting the feed solution to a first extraction to obtain an aqueous phase 1 and an organic phase 1;

(2) subjecting the aqueous phase 1 obtained in step (1) to a second extraction to obtain an organic phase 2 and an aqueous phase 2 with a pH value of 5-7.5; and (3) subjecting the organic phase 2 obtained in step (2) to washing and back extraction in sequence to obtain a solution containing nickel, cobalt and manganese;

wherein an extractant A used in the second extraction includes a carboxylic acid extractant; the carboxylic acid extractant has the following structural general formula:

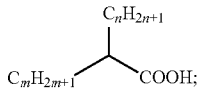

wherein $10 \leq m+n \leq 22$, and $—C_nH_{2n+1}$ and $—C_mH_{2m+1}$ are each independently linear or branched alkyl with 1-21 carbon atoms.

The method provided in the present application realizes synchronous extraction and recovery of nickel, cobalt and manganese from the battery feed solution containing nickel, cobalt and manganese, which is not affected by impurity metal ions such as calcium and magnesium. The method has simple operation and stable process, and reduces the separation cost of separately recovering nickel, cobalt and manganese and the extraction and purification cost of impurity metal ions. Meanwhile, the impurity removal rates of the carboxylic acid extractant are all more than or equal to 99.0% for Ni, Co and Mn, and the sulfuric acid back extraction rate is more than or equal to 99.5%.

In the present application, the pH value of the aqueous phase 2 obtained in the second extraction in step (2) is 5-7.5, such as 5, 5.2, 5.4, 5.6, 5.8, 6, 6.2, 6.4, 6.6, 6.8, 7 or 7.5, but the pH value is not limited to the listed values, and other unlisted values in this range are also applicable; the pH value is optionally 5-6.8.

In the present application, the carboxylic acid of the extractant A has a volume fraction of 5-30%, such as 5%, 10%, 15%, 20%, 25% or 30%, but the volume fraction is not limited to the listed values, and other unlisted values in this range are also applicable.

As an optional technical solution of the present application, a metal element in the feed solution includes 1-16 g/L Li, 1-50 g/L Ni, 1-26 g/L Co, 1-30 g/L Mn, less than or equal to 10 g/L of Fe, less than or equal to 1 g/L of Al, less than or equal to 10 g/L of Cu, less than or equal to 5 g/L of Zn, 0.1-0.5 g/L Ca and 0.1-50 g/L Mg.

In the present application, Li in the feed solution has a concentration of 1-16 g/L, such as 1 g/L, 5 g/L, 8 g/L, 9 g/L, 10 g/L, 11 g/L, 12 g/L, 13 g/L, 14 g/L, 15 g/L or 16 g/L, but the concentration is not limited to the listed values, and other unlisted values in this range are also applicable.

In the present application, Ni in the feed solution has a concentration of 1-50 g/L, such as 1 g/L, 10 g/L, 20 g/L, 30 g/L, 40 g/L, 41 g/L, 42 g/L, 43 g/L, 44 g/L, 45 g/L, 46 g/L, 47 g/L, 48 g/L, 49 g/L or 50 g/L, but the concentration is not limited to the listed values, and other unlisted values in this range are also applicable.

In the present application, Co in the feed solution has a concentration of 1-26 g/L, such as 1 g/L, 5 g/L, 15 g/L, 16 g/L, 17 g/L, 18 g/L, 19 g/L, 20 g/L, 21 g/L, 22 g/L, 23 g/L, 24 g/L, 25 g/L or 26 g/L, but the concentration is not limited to the listed values, and other unlisted values in this range are also applicable.

In the present application, Mn in the feed solution has a concentration of 1-30 g/L, such as 1 g/L, 5 g/L, 10 g/L, 20 g/L or 30 g/L, but the concentration is not limited to the listed values, and other unlisted values in this range are also applicable.

In the present application, Fe in the feed solution has a concentration of less than or equal to 10 g/L, such as 10 g/L, 9 g/L, 8 g/L, 7 g/L, 6 g/L, 5 g/L, 4 g/L or 3 g/L, but the concentration is not limited to the listed values, and other unlisted values in this range are also applicable.

In the present application, Al in the feed solution has a concentration of less than or equal to 1 g/L, such as 1 g/L, 0.8 g/L, 0.6 g/L, 0.4 g/L or 0.2 g/L, but the concentration is not limited to the listed values, and other unlisted values in this range are also applicable.

In the present application, Cu in the feed solution has a concentration of less than or equal to 10 g/L, such as 10 g/L, 9 g/L, 8 g/L, 7 g/L, 6 g/L, 5 g/L, 4 g/L or 3 g/L, but the concentration is not limited to the listed values, and other unlisted values in this range are also applicable.

In the present application, Zn in the feed solution has a concentration of less than or equal to 5 g/L, such as 5 g/L, 4 g/L, 3 g/L, 2 g/L or 1 g/L, but the concentration is not limited to the listed values, and other unlisted values in this range are also applicable.

In the present application, Ca in the feed solution has a concentration of 0.1-0.5 g/L, such as 0.1 g/L, 0.2 g/L, 0.3 g/L, 0.4 g/L or 0.5 g/L, but the concentration is not limited to the listed values, and other unlisted values in this range are also applicable.

In the present application, Mg in the feed solution has a concentration of 0.1-50 g/L, such as 0.1 g/L, 10 g/L, 20 g/L, 30 g/L, 40 g/L or 50 g/L, but the concentration is not limited to the listed values, and other unlisted values in this range are also applicable.

As an optional technical solution of the present application, an extractant B used in the first extraction in step (1) includes one or a combination of at least two of a phosphorus extractant, a carboxylic acid extractant or an oxime extractant.

In the present application, the phosphorus extractant includes one or a combination of at least two of P204, P507 or C272.

In the present application, the oxime extractant includes any one or a combination of at least one of Mextral 984H, Lix63 or CP50.

In the present application, if the feed solution contains copper ions, the oxime extractant is preferably used to remove the copper from the feed solution first, and then nickel, cobalt and manganese in the feed solution are recovered by the method of the present application.

Optionally, the carboxylic acid extractant has the following structural general formula:

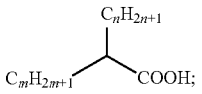

wherein $10 \leq m+n \leq 22$, and —$C_nH_{2n+1}$ and $C_mH_{2m+1}$ are each independently linear or branched alkyl with 1-21 carbon atoms.

Optionally, the carboxylic acid extractant is one carboxylic acid or a mixture of at least two carboxylic acids.

Optionally, the extractant B has a volume fraction of 5-30%, such as 5%, 10%, 15%, 20%, 25% or 30%, but the volume fraction is not limited to the listed values, and other unlisted values in this range are also applicable.

Optionally, a diluent of the extractant B includes one or a combination of at least two of solvent oil, kerosene, Escaid 110, hexane, heptane and dodecane. The combination can be a combination of solvent oil and kerosene, a combination of Escaid 110 and hexane, or a combination of heptane and dodecane, but the diluent is not limited to the listed combination, and other unlisted combinations in this range are also applicable.

In the present application, the solvent can be solvent oil No. 200 and/or solvent oil No. 260.

Optionally, the extractant B is saponified before use.

Optionally, the saponification is carried out by using a 6-14 mol/L alkaline solution, such as 6 mol/L, 7 mol/L, 8 mol/L, 9 mol/L, 10 mol/L, 11 mol/L, 12 mol/L, 13 mol/L or 14 mol/L, but the concentration is not limited to the listed values, and other unlisted values in this range are also applicable.

Optionally, the alkaline solution includes one or a combination of at least two of a sodium hydroxide solution, a potassium hydroxide solution or aqueous ammonia. The combination can be a combination of a sodium hydroxide solution and a potassium hydroxide solution, or a combination of a potassium hydroxide solution and aqueous ammonia, but the alkaline solution is not limited to the listed combination, and other unlisted combinations in this range are also applicable.

As an optional technical solution of the present application, the first extraction in step (1) includes single-stage extraction or multi-stage countercurrent extraction.

Optionally, the extractant B used in the first extraction in step (1) and the feed solution have a volume ratio of (0.1-10):1, such as 0.1:1, 0.5:1, 1:1, 2:1, 3:1, 4:1, 5:1, 6:1, 7:1, 8:1, 9:1 or 10:1, but the volume ratio is not limited to the listed values, and other unlisted values in this range are also applicable.

Optionally, the first extraction in step (1) has a stirring speed of 100-250 r/min, such as 100 r/min, 150 r/min, 200 r/min or 250 r/min, but the stirring speed is not limited to the listed values, and other unlisted values in this range are also applicable.

Optionally, the first extraction in step (1) has a mixing time of 5-30 min, such as 5 min, 10 min, 15 min, 20 min, 25 min or 30 min, but the mixing time is not limited to the listed values, and other unlisted values in this range are also applicable.

Optionally, the multi-stage countercurrent extraction has 2-30 stages, such as 2, 3, 5, 10, 15, 20, 25 or 30, but the number of stages is not limited to the listed values, and other unlisted values in this range are also applicable.

As an optional technical solution of the present application, the extractant A has a volume fraction of 5-30%, such as 5%, 10%, 15%, 20%, 25% or 30%, but the volume fraction is not limited to the listed values, and other unlisted values in this range are also applicable.

Optionally, the carboxylic acid extractant in the extractant A is one carboxylic acid or a mixture of at least two carboxylic acids.

Optionally, a diluent of the extractant A includes one or a combination of at least two of solvent oil, kerosene, Escaid 110, hexane, heptane and dodecane. The combination can be a combination of solvent oil and kerosene, a combination of Escaid 110 and hexane, or a combination of heptane and dodecane, but the combination is not limited to the listed combination, and other unlisted combinations in this range are also applicable.

In the present application, the solvent can be solvent oil No. 200 and/or solvent oil No. 260.

In the present application, the dodecane can be n-dodecane.

Optionally, the extractant A is saponified before use.

Optionally, the saponification is carried out by using a 6-14 mol/L alkaline solution, such as 6 mol/L, 7 mol/L, 8 mol/L, 9 mol/L, 10 mol/L, 11 mol/L, 12 mol/L, 13 mol/L or 14 mol/L, but the concentration is not limited to the listed values, and other unlisted values in this range are also applicable.

Optionally, the alkaline solution includes one or a combination of at least two of a sodium hydroxide solution, a potassium hydroxide solution or aqueous ammonia.

The combination can be a combination of a sodium hydroxide solution and a potassium hydroxide solution, or a combination of a potassium hydroxide solution and aqueous ammonia, but the alkaline solution is not limited to the listed combination, and other unlisted combinations in this range are also applicable. As an optional technical solution of the present application, the second extraction in step (2) is multi-stage countercurrent extraction.

Optionally, the extractant A in the second extraction in step (2) and the aqueous phase 1 have a volume ratio of (0.1-10):1, such as 0.1:1, 0.5:1, 1:1, 2:1, 3:1, 4:1, 5:1, 6:1, 7:1, 8:1, 9:1 or 10:1, but the volume ratio is not limited to the listed values, and other unlisted values in this range are also applicable.

Optionally, the second extraction in step (2) has a stirring speed of 100-250 r/min, such as 100 r/min, 150 r/min, 200 r/min or 250 r/min, but the stirring speed is not limited to the listed values, and other unlisted values in this range are also applicable.

Optionally, the second extraction in step (2) has a mixing time of 5-30 min, such as 5 min, 10 min, 15 min, 20 min, 25 min or 30 min, but the mixing time is not limited to the listed values, and other unlisted values in this range are also applicable.

Optionally, the multi-stage countercurrent extraction of the second extraction has 5-30 stages, such as 5, 10, 15, 20, 25 or 30, but the number of stages is not limited to the listed values, and other unlisted values in this range are also applicable.

As an optional technical solution of the present application, the method further includes subjecting the organic phase 1 in step (1) to multi-stage countercurrent washing and then back extraction to obtain a solution containing metal ions and an organic phase 3.

Optionally, the washing has 2-10 stages, such as 2, 3, 4, 5, 6, 7, 8, 9 or 10, but the number of stages is not limited to the listed values, and other unlisted values in this range are also applicable.

Optionally, the organic phase 3 is returned to be used as an extractant.

In the present application, the organic phase 1 is subjected to multi-stage countercurrent washing with acid, and then subjected to back extraction with an acid solution, the obtained mixing solution containing iron, copper, zinc and aluminum is subjected to oil removal and then concentration and crystallization, and the organic phase is returned to the saponification process for recycling. The acid used for the washing and back extraction includes hydrochloric acid and/or sulfuric acid. The organic phase 3 and the acid used in washing or the organic phase 3 and the acid used in back extraction have a volume ratio of (0.1-10):1, such as 0.1:1, 0.5:1, 1:1, 2:1, 3:1, 4:1, 5:1, 6:1, 7:1, 8:1, 9:1 or 10:1, but the volume ratio is not limited to the listed values, and other unlisted values in this range are also applicable. The back extraction uses hydrochloric acid with a concentration of 1-4 mol/L, such as 1 mol/L, 1.5 mol/L, 2 mol/L, 2.5 mol/L, 3 mol/L or 4 mol/L, but the concentration is not limited to the listed values, and other unlisted values in this range are also applicable. The back extraction uses sulfuric acid with a concentration of 0.5-3.5 mol/L, such as 0.5 mol/L, 1 mol/L, 2 mol/L, 3 mol/L or 3.5 mol/L, but the concentration is not limited to the listed values, and other unlisted values in this range are also applicable.

As an optional technical solution of the present application, the method includes subjecting the aqueous phase 2 in step (2) to oil removal and crystallization in sequence to obtain sodium sulfate crystals.

Optionally, the crystallization is carried out in a manner of MVR evaporation.

In the present application, the oil removal can be carried out in a conventional manner in the prior art, as long as the oil phase and aqueous phase can be separated.

As an optional technical solution of the present application, the washing in step (3) is multi-stage countercurrent washing.

Optionally, the washing has 2-10 stages, such as 2, 3, 4, 5, 6, 7, 8, 9 or 10, but the number of stages is not limited to the listed values, and other unlisted values in this range are also applicable.

In the present application, the organic phase 2 is washed and back-extracted by sulfuric acid and/or hydrochloric acid; the organic phase 2 and the acid used for washing and back extraction have a volume ratio of (0.1-10):1, such as 0.1:1, 0.5:1, 1:1, 2:1, 3:1, 4:1, 5:1, 6:1, 7:1, 8:1, 9:1 or 10:1, but the volume ratio is not limited to the listed values, and other unlisted values in this range are also applicable. The hydrochloric acid used in the back extraction has a concentration of 1-4 mol/L, such as 1 mol/L, 1.5 mol/L, 2 mol/L, 2.5 mol/L, 3 mol/L or 4 mol/L, but the concentration is not limited to the listed values, and other unlisted values in this range are also applicable. The sulfuric acid used in the back extraction has a concentration of 0.5-3.5 mol/L, such as 0.5 mol/L, 1 mol/L, 2 mol/L, 3 mol/L or 3.5 mol/L, but the concentration is not limited to the listed values, and other unlisted values in this range are also applicable.

As an optional technical solution of the present application, the method includes the following steps:

(1) subjecting the feed solution to a first extraction to obtain an aqueous phase 1 and an organic phase 1; wherein an extractant B used in the first extraction includes one or a combination of at least two of a phosphorus extractant, a carboxylic acid extractant or an oxime extractant; the carboxylic acid extractant has the following structural general formula:

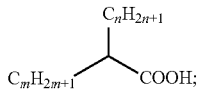

wherein $10 \leq m+n \leq 22$, and $—C_nH_{2n+1}$ and $—C_mH_{2m+1}$ are each independently linear or branched alkyl with 1-21 carbon atoms; the extractant B has a volume fraction of 5-30%; the first extraction includes single-stage extraction or multi-stage countercurrent extraction; the extractant B used in the first extraction and the feed solution have a volume ratio of (0.1-10):1; the first extraction has a stirring speed of 100-250 r/min; the first extraction has a mixing time of 5-30 min; the multi-stage countercurrent extraction has 2-30 stages;

(2) subjecting the aqueous phase 1 obtained in step (1) to a second extraction to obtain an organic phase 2 and an aqueous phase 2 with a pH value of 5-7.5; wherein an extractant A used in the second extraction includes a carboxylic acid extractant; the carboxylic acid extractant has the following structural general formula:

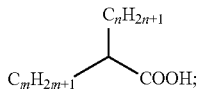

wherein $10 \leq m+n \leq 22$, and $—C_nH_{2n+1}$ and $—C_mH_{2m+1}$ are each independently linear or branched 20 alkyl with 1-21 carbon atoms; the extractant A has a volume fraction of 5-30%; the second extraction is multi-stage countercurrent extraction; the extractant A used in the second extraction and the aqueous phase 1 have a volume ratio of (0.1-10):1; the second extraction has a stirring speed of 100-250 r/min; the second extraction has a mixing time of 5-30 min; the multi-stage countercurrent extraction of the second extraction has 5-30 stages; and (3) subjecting the organic phase 2 obtained in step (2) to washing and back extraction in sequence to obtain a solution containing nickel, cobalt and manganese; wherein the washing is multi-stage countercurrent washing; the washing has 2-10 stages.

In the present application, the operating pH value of the first extraction has different operating pH intervals due to different extractants, which is not specifically limited in the present application, and can be selected according to the impurity ions to be removed in the first extraction with reference to the prior art. For example, when P204 is used, the pH value of the first extraction is 2.5-3.5, and when the oxime extractant is used, the pH value of the first extraction is 2-2.5.

In the present application, the extractant obtained by back-extracting the organic phase 2 can be saponified and then returned to the extraction operation.

In the present application, the carboxylic acid extractant can be one carboxylic acid or a mixture of more carboxylic acids, such as extractant BC196 (a compound corresponding to the general formula where m=8 and n=8), extractant BC191 (a compound corresponding to the general formula where m=8 and n=10), a mixture of extractant BC196 and BC191, or extractant BC194 (a compound corresponding to the general formula where m=6 and n=6).

In the present application, the countercurrent extraction is one of the extraction and separation operations, in which the aqueous phase containing the substance to be extracted and the organic phase flow into the extractor from the two ends respectively, flow in opposite directions, contact with each other by continuous multi-stage stirring, and are separated into layers to achieve separation.

In the present application, the reaction equations of the corresponding processes are as follows:

Saponification of carboxylic acid extractant:

$$HA_{(org)}+NaOH \rightarrow NaA_{(org)}+H_2O$$

Extraction of carboxylic acid extractant:

$$2NaA_{(org)}+MSO_4 \rightarrow MA_{2(org)}+Na_2SO_4$$

Back extraction of sulfuric acid:

$$MA_{2(org)}+H_2SO_4 \rightarrow 2HA_{(org)}+MSO_4$$

In the equation: M is $Fe^{3+}$, $Cu^{2+}$, $Al^{3+}$, $Zn^{2+}$, $Co^{2+}$, $Mn^{2+}$ or other metals.

Compared with the prior technical solutions, the present application has the following beneficial effects:

(1) The method provided in the present application has a good separation effect on metal ions, and realizes synchronous extraction and recovery of nickel, cobalt and manganese from the battery feed solution containing nickel, cobalt and manganese by using the coupling effect of extractant and extraction pH, which is not affected by impurity metal ions such as calcium and 5 magnesium, and the method has simple operation, and reduces the separation cost of separately recovering nickel, cobalt and manganese and the extraction and purification cost of impurity metal ions; additionally, the carboxylic acid extractant has low water solubility and can be recycled;

(2) In the recovery method provided in the present application, the impurity removal rate is more than or equal to 99%, the extraction rates of nickel, cobalt manganese are more than or equal to 99%, and the sulfuric acid back extraction rate is more than or equal to 99.5%.

BRIEF DESCRIPTION OF DRAWINGS

FIG. 1 is a schematic diagram of a recovery method in Example 1 of the present application.

The present application will be further described in detail hereinafter. However, the following embodiments are only simple examples of the present application, and do not represent or limit the protection scope of the claims of the present application. The protection scope of the present application is defined by the appended claims.

DETAILED DESCRIPTION

For both a better explanation of the present application and a better understanding of the technical solutions of the present application, the typical but non-limiting embodiments of the present application are described below.

Example 1

This example provides a method for recycling nickel, cobalt and manganese from a feed solution containing nickel, cobalt and manganese, as shown in FIG. 1.

The feed solution in this example is a battery feed solution containing nickel, cobalt and manganese, the feed solution has a pH value of 4.46, and the components are as follows:

| | Element | | | | | | | | | |
|---|---|---|---|---|---|---|---|---|---|---|
| | Fe | Al | Zn | Cu | Ni | Co | Mn | Ca | Mg | Li |
| Content (g/L) | 0.001 | 0.001 | 0.5 | 0.8 | 46 | 22 | 20 | 0.4 | 0.3 | 9 |

In this example, the copper in the feed solution was extracted by using the saponified Mextral 984H extractant (a volume fraction was 15%, a diluent was solvent oil No. 260, and an 8 mol/L NaOH solution was used for the saponification) before a first extraction, the extraction had 1 stage, the organic phase and the feed solution had a volume ratio of 0.25:1, a mixing time was 10 min, a stirring speed was 120 r/min, the system was allowed to stand for 10 min, an experimental temperature was 25° C., and a pH of the aqueous phase was controlled at 2.5. After phase separation, a copper-loaded organic phase and a copper-removed feed solution were obtained separately. The copper-loaded organic phase was subjected to one-stage countercurrent washing by using a dilute sulfuric acid at pH 1, and then subjected to back extraction twice by using a 2 mol/L sulfuric acid. The organic phase 1 and the washing solution or the organic phase 1 and the back extraction solution had a volume ratio of 10:1. The obtained copper sulfate solution was subjected to oil removal and then concentration and crystallization.

In this example, the first extraction adopted C272 as the extractant, a volume fraction was 15%, and a diluent was solvent oil No. 260, and the extractant was saponified by an 8 mol/L NaOH solution.

The copper-removed feed solution was subjected to multi-stage countercurrent extraction by using the saponified C272, the extraction had 2 stages, the organic phase and the copper-removed feed solution had a volume ratio of 0.25:1, a mixing time was 10 min, a stirring speed was 120 r/min, and an experimental temperature was 25° C. After phase separation, an organic phase 1 and an aqueous phase 1 at pH 3 were obtained separately, and the organic phase 1 was subjected to four-stage countercurrent washing by using a dilute sulfuric acid at pH 1, and then subjected to back extraction twice by using a 2 mol/L sulfuric acid. The organic phase 1 and the washing solution or the organic phase 1 and the back extraction solution had a volume ratio of 10:1. The obtained zinc sulfate solution was subjected to oil removal and then concentration and crystallization. The organic phase was returned to the saponification process for recycling.

The aqueous phase 1 was subjected to multi-stage countercurrent extraction by using the saponified Mextral BC191 extractant (a volume fraction was 25%, a diluent was solvent oil No. 260, and a 14 mol/L NaOH solution was used for the saponification), the extraction had 15 stages, the organic phase and the aqueous phase 1 had a volume ratio of 3:1, a mixing time was 10 min, a stirring speed was 120 r/min, the system was allowed to stand for 10 min, an experimental temperature was 25° C., and an organic phase 2 and an aqueous phase 2 at pH 6 were obtained separately. The organic phase 2 was subjected to five-stage countercurrent washing by using a dilute sulfuric acid at pH 1, and then subjected to back extraction six times by using a 2 mol/L sulfuric acid. The organic phase 2 and the washing solution or the organic phase 2 and the back extraction solution had a volume ratio of 9:1. Thus a solution rich in nickel, cobalt and manganese was obtained.

In this example, the impurity removal rate is 99.2%, the extraction rates of Ni, Co and Mn are 99.8%, 99.7% and 99.6% respectively, and the back extraction rates are 99.5%, 99.6% and 99.6% respectively.

Example 2

This example provides a method for recycling nickel, cobalt and manganese from a feed solution containing nickel, cobalt and manganese, the feed solution in this example is a battery 15 feed solution containing nickel, cobalt and manganese, the feed solution has a pH value of 1.59, and the components are as follows:

| | Element | | | | | | | | | |
|---|---|---|---|---|---|---|---|---|---|---|
| | Fe | Al | Zn | Cu | Ni | Co | Mn | Ca | Mg | Li |
| Content (g/L) | 0.5 | 0.01 | 0.3 | 0.6 | 48 | 22 | 18 | 0.5 | 0.5 | 10 |

In this example, BC196 was used as the extractant, a volume fraction was 25%, and a diluent was Escaid 110, and the extractant was saponified by a 6 mol/L NaOH solution.

The feed solution containing nickel, cobalt and manganese was subjected to eight-stage countercurrent extraction by using the saponified BC196, the extractant and the battery feed solution had a volume ratio of 0.2:1, a mixing time was 8 min, a stirring speed was 150 r/min, and an experimental temperature was 25° C. After phase separation, the organic phase 1 and the aqueous phase 1 at pH 5.7 were obtained separately. The organic phase 1 was subjected to eight-stage countercurrent washing by using a dilute sulfuric acid at pH 1.5, and then subjected to back extraction thrice by using a 2.5 mol/L sulfuric acid. The organic phase 1 and the washing solution or the organic phase 1 and the back extraction solution had a volume ratio of 10:1. The obtained mixing solution of ferric sulfate, copper sulfate, zinc sulfate and aluminum sulfate was subjected to oil removal and then concentration and crystallization. The organic phase was returned to the saponification process for recycling.

The aqueous phase 1 was subjected to multi-stage countercurrent extraction by using the saponified BC196, the extraction had 8 stages, the organic phase and the aqueous phase 1 had a volume ratio of 4:1, a mixing time was 8 min, a stirring speed was 150 r/min, the system was allowed to stand for 15 min, an experimental temperature was 25° C., and an organic phase 2 and an aqueous phase 2 at pH 6.4 were obtained separately. The organic phase 2 was subjected to seven-stage countercurrent washing by using a dilute sulfuric acid at pH 1.5, and then subjected to back extraction five times by using a 2.5 mol/L sulfuric acid. The organic phase 2 and the washing solution or the organic phase 2 and the back extraction solution had a volume ratio of 10:1. Thus a solution rich in nickel, cobalt and manganese was obtained.

In this example, the impurity removal rate is 99.4%, the extraction rates of Ni, Co and Mn are 99.8%, 99.6% and 99.5% respectively, and the back extraction rates are 99.7%, 99.7% and 99.6% respectively.

Example 3

This example provides a method for recycling nickel, cobalt and manganese from a feed solution containing nickel, cobalt and manganese, the feed solution in this example is a battery feed solution containing nickel, cobalt and manganese, the feed solution has a pH value of 4.3, and the components are as follows:

| | Element | | | | | | | | | |
|---|---|---|---|---|---|---|---|---|---|---|
| | Fe | Al | Zn | Cu | Ni | Co | Mn | Ca | Mg | Li |
| Content (g/L) | 0.001 | 0.001 | 0.5 | 0.7 | 48 | 24 | 20 | 0.5 | 0.5 | 10 |

In this example, the copper in the feed solution was extracted by using the saponified CP50 extractant (a volume fraction was 20%, a diluent was sulfonated kerosene, and a saponifier was an 8 mol/L NaOH solution) before a first extraction, the extraction had 1 stage, a ratio was 0.25:1, a mixing time was 5 min, a stirring speed was 200 r/min, the system was allowed to stand for 20 min, an experimental temperature was 20° C., and a pH of the aqueous phase was controlled at 2.5. After phase separation, a copper-loaded organic phase and a copper-removed feed solution were obtained separately. The copper-loaded organic phase was subjected to one-stage countercurrent washing by using a dilute sulfuric acid at pH 1, and then subjected to back extraction twice by using a 2 mol/L sulfuric acid. The organic phase 1 and the washing solution or the organic phase 1 and the back extraction solution had a volume ratio of 10:1. The obtained copper sulfate solution was subjected to oil removal and then concentration and crystallization.

In this example, the first extraction adopted P204 as the extractant, a volume fraction was 20%, and a diluent was sulfonated kerosene, and the extractant was saponified by an 8 mol/L NaOH solution.

The copper-removed feed solution containing nickel, cobalt and manganese was subjected to seven-stage countercurrent extraction by using the saponified P204, the extractant and the copper-removed feed solution had a volume ratio of 0.25:1, a mixing time was 5 min, a stirring speed was 200 r/min, and an experimental temperature was 20° C. After phase separation, an organic phase 1 and an aqueous phase 1 at pH 2 were obtained separately, and the organic phase 1 was subjected to four-stage countercurrent washing by using hydrochloric acid at pH 1, and then subjected to back extraction twice by using a 4 mol/L hydrochloric acid. The organic phase 1 and the washing solution or the organic phase 1 and the back extraction solution had a volume ratio of 10:1. The obtained mixing solution of calcium chloride and zinc chloride was subjected to oil removal and then concentration and crystallization. The organic phase was returned to the saponification process for recycling.

The aqueous phase 1 was subjected to a second extraction by using the saponified BC194 (a volume fraction was 30%, a diluent was Escaid 110, and a saponifier was a 10 mol/L NaOH solution), the extraction was multi-stage countercurrent extraction with 7 stages, the BC194 extractant and the aqueous phase 1 had a volume ratio of 3:1, a mixing time was 5 min, a stirring speed was 200 r/min, an experimental temperature was 20° C., and an organic phase 2 and an aqueous phase 2 at pH 6.8 were obtained separately. The organic phase 2 was subjected to eight-stage countercurrent washing by using sulfuric acid at pH 1, and then subjected to back extraction six times by using a 2 mol/L sulfuric acid. The organic phase 2 and the washing solution or the organic phase 2 and the back extraction solution had a volume ratio of 9:1. Thus a solution rich in nickel, cobalt and manganese was obtained.

In this example, the impurity removal rate is 99.3%, the extraction rates of Ni, Co and Mn are 99.8%, 99.7% and 99.6% respectively, and the back extraction rates are 99.7%, 99.6% and 99.5% respectively.

Example 4

The only difference from Example 1 is that the pH of the aqueous phase 2 was controlled at 7.5. In this example, the impurity removal rate is 99.3%, the extraction rates of Ni, Co and Mn are 99.7%, 99.8% and 99.6% respectively, and back extraction rates are 99.7%, 99.6% and 99.6% respectively. The washing processes were increased, and the washing cost was increased.

Comparative Example 1

The only difference from Example 1 is that the pH of the aqueous phase 2 obtained in the second extraction was controlled at 5. The single-stage extraction rates of Ni, Co and Mn are all less than 10%.

Comparative Example 2

The only difference from Example 1 is that the extractant in the second extraction was replaced with the same amount of P204, and the nickel, cobalt and manganese could not be extracted synchronously.

Comparative Example 3

The difference from Example 1 is that the extractant in the second extraction was replaced by carboxylic acid extractant CA-100. The extraction rates of Ni, Co and Mn are 78.8%, 74.5% and 73% respectively.

According to the results of the above examples and comparative examples, the method provided in the present application realizes synchronous extraction and recovery of nickel, cobalt and manganese from the leachate of waste lithium-ion battery positive electrode materials by using the coupling effect of extractant and extraction pH, which is not affected by impurity metal ions such as calcium and magnesium. The method has simple operation, and reduces the separation cost of separately recovering nickel, cobalt and manganese and the extraction and purification cost of impurity metal ions. Meanwhile, the impurity removal rate of the carboxylic acid extractant is more than or equal to 99.0%, and the sulfuric acid back extraction rate is more than or equal to 99.5%.

The applicant has stated that the detailed structural features of the present application are illustrated by the above embodiments, but the present application is not limited to the above detailed structural features, which means that the present application is not necessarily rely on the above detailed structural features to be implemented.

Although the optional embodiments of the present application have been described above in detail, the present application is not limited to details of the above embodiments, and various simple modifications can be made to the technical solutions of the present application without departing from the technical concept of the present application.

In addition, it should be noted that if not in collision, the specific technical features described in the above embodiments may be combined in any suitable manner. To avoid unnecessary repetition, the present application does not further specify any of various combinations.

In addition, the different embodiments of the present application can also be combined in any manner, and those combinations should also be regarded as the content disclosed in the present application without departing from the idea of the present application.

What is claimed is:

1. A method for recycling nickel, cobalt and manganese from a feed solution containing nickel, cobalt and manganese, comprising (1) subjecting the feed solution to a first extraction to obtain an aqueous phase 1 and an organic phase 1;

(2) subjecting the aqueous phase 1 obtained in step (1) to a second extraction to obtain an organic phase 2 and an aqueous phase 2 with a pH value of 6-7.5; and (3) subjecting the organic phase 2 obtained in step (2) to washing and back extraction in sequence to obtain a solution containing nickel, cobalt and manganese;

wherein an extractant A used in the second extraction is a carboxylic acid extractant; the carboxylic acid extractant has the following structural general formula:

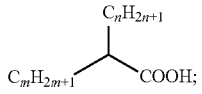

wherein $10 \leq m+n \leq 22$, and —$C_nH_{2n+1}$ and —$C_mH_{2m+1}$ are each independently linear or branched alkyl with 1-21 carbon atoms.

2. The method according to claim 1, wherein a metal element in the feed solution comprises 1-16 g/L Li, 1-50 g/L Ni, 1-26 g/L Co, 1-30 g/L Mn, less than or equal to 10 g/L of Fe, less than or equal to 1 g/L of Al, less than or equal to 10 g/L of Cu, less than or equal to 5 g/L of Zn, 0.1-0.5 g/L Ca and 0.1-50 g/L Mg.

3. The method according to claim 1, wherein an extractant B used in the first extraction in step (1) comprises one or a combination of at least two of a phosphorus extractant, a carboxylic acid extractant or an oxime extractant.

4. The method according to claim 3, wherein the carboxylic acid extractant comprised in the extractant B used in the first extraction in step (1) has the following structural general formula:

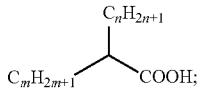

wherein $10 \leq m+n \leq 22$, and —$C_nH_{2n+1}$ and —$C_mH_{2m+1}$ are each independently linear or branched alkyl with 1-21 carbon atoms;

the carboxylic acid extractant is one carboxylic acid or a mixture of at least two carboxylic acids;

the extractant B has a volume fraction of 5-30%;

a diluent of the extractant B comprises one or a combination of at least two of solvent oil, kerosene, hexane, heptane and dodecane;

the extractant B is saponified before use;

the saponification is carried out by using a 6-14 mol/L alkaline solution;

the alkaline solution comprises one or a combination of at least two of a sodium hydroxide solution, a potassium hydroxide solution or aqueous ammonia.

5. The method according to claim 3, wherein the first extraction in step (1) comprises single-stage extraction or multi-stage countercurrent extraction;

the extractant B used in the first extraction in step (1) and the feed solution have a volume ratio of (0.1-10):1;

the first extraction in step (1) has a stirring speed of 100-250 r/min;

the first extraction in step (1) has a mixing time of 5-30 min;

the multi-stage countercurrent extraction has 2-30 stages.

6. The method according to claim 1, wherein the extractant A has a volume fraction of 5-30%;

the carboxylic acid extractant in the extractant A is one carboxylic acid or a mixture of at least two carboxylic acids;

a diluent of the extractant A comprises one or a combination of at least two of solvent oil, kerosene, hexane, heptane and dodecane;

the extractant A is saponified before use;

the saponification is carried out by using a 6-14 mol/L alkaline solution;

the alkaline solution comprises one or a combination of at least two of a sodium hydroxide solution, a potassium hydroxide solution or aqueous ammonia.

7. The method according to claim 1, wherein the second extraction in step (2) is multi-stage countercurrent extraction;

the extractant A used in the second extraction in step (2) and the aqueous phase 1 have a volume ratio of (0.1-10):1;

the second extraction in step (2) has a stirring speed of 100-250 r/min;

the second extraction in step (2) has a mixing time of 5-30 min;

the multi-stage countercurrent extraction of the second extraction has 5-30 stages.

8. The method according to claim 1, wherein the method further comprises subjecting the organic phase 1 in step (1) to multi-stage countercurrent washing and then back extraction to obtain a solution containing metal ions and an organic phase 3;

the washing has 2-10 stages;

the organic phase 3 is returned to be used as an extractant.

9. The method according to claim 1, wherein the method comprises subjecting the aqueous phase 2 in step (2) to oil removal and crystallization in sequence to obtain sodium sulfate crystals;

the crystallization is carried out in a manner of MVR evaporation.

10. The method according to claim 1, wherein the washing in step (3) is multi-stage countercurrent washing;

the washing has 2-10 stages.

11. A method for recycling nickel, cobalt, and manganese from a feed solution containing nickel, cobalt, and manganese, comprising (1) subjecting the feed solution to a first extraction to obtain an aqueous phase 1 and an organic phase 1; wherein an extractant B used in the first extraction comprises one or a combination of at least two of a phosphorus extractant, a carboxylic acid extractant or an oxime extractant; the carboxylic acid extractant has the following structural general formula:

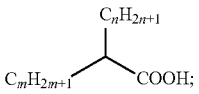

wherein $10<m+n\leq 22$, and —$C_nH_{2n+1}$ and —$C_mH_{2m+1}$ are each independently linear or branched alkyl with 1-21 carbon atoms; the extractant B has a volume fraction of 5-30%; the first extraction comprises single-stage extraction or multi-stage countercurrent extraction; the extractant B used in the first extraction and the feed solution have a volume ratio of (0.1-10):1; the first extraction has a stirring speed of 100-250 r/min; the first extraction has a mixing time of 5-30 min; the multi-stage countercurrent extraction has 2-30 stages;

(2) subjecting the aqueous phase 1 obtained in step (1) to a second extraction to obtain an organic phase 2 and an aqueous phase 2 with a pH value of 6-7.5; wherein an extractant A used in the second extraction is a carboxylic acid extractant; the carboxylic acid extractant has the following structural general formula:

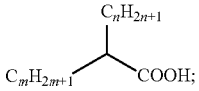

wherein $10\leq m+n\leq 22$, and —$C_nH_{2n+1}$ and —$C_mH_{2m+1}$ are each independently linear or branched alkyl with 1-21 carbon atoms; the extractant A has a volume fraction of 5-30%; the second extraction is multi-stage countercurrent extraction; the extractant A used in the second extraction and the aqueous phase 1 have a volume ratio of (0.1-10):1; the second extraction has a stirring speed of 100-250 r/min; the second extraction has a mixing time of 5-30 min; the multi-stage countercurrent extraction of the second extraction has 5-30 stages; and (3) subjecting the organic phase 2 obtained in step (2) to washing and back extraction in sequence to obtain a solution containing nickel, cobalt and manganese; wherein the washing is multi-stage countercurrent washing; the washing has 2-10 stages.

* * * * *